US008109389B1

(12) United States Patent
Amer

(10) Patent No.: US 8,109,389 B1
(45) Date of Patent: Feb. 7, 2012

(54) SHIPPING CONTAINER ASSEMBLY FOR ELECTRICAL STORAGE CELLS

(75) Inventor: John Amer, Davison, MI (US)

(73) Assignee: Genesee Packaging, Inc., Flint, MI (US)

( * ) Notice: Subject to any disclaimer, the term of this patent is extended or adjusted under 35 U.S.C. 154(b) by 91 days.

(21) Appl. No.: 12/645,571

(22) Filed: Dec. 23, 2009

Related U.S. Application Data

(60) Provisional application No. 61/140,162, filed on Dec. 23, 2008.

(51) Int. Cl.
*B65D 85/30* (2006.01)

(52) U.S. Cl. ..... 206/704; 206/499; 206/592; 206/728; 220/23.88

(58) Field of Classification Search ..... 206/703–705, 206/707, 708, 712, 721, 723, 725–728, 499, 206/784, 585, 587, 591, 592, 594; 220/23.83, 220/23.88, 23.89; 229/915, 917
See application file for complete search history.

(56) References Cited

U.S. PATENT DOCUMENTS

| | | | | |
|---|---|---|---|---|
| 3,253,703 | A * | 5/1966 | Ettin | 206/784 |
| 4,640,418 | A * | 2/1987 | Lowry | 206/499 |
| 4,744,464 | A * | 5/1988 | Noe | 206/422 |
| 5,439,108 | A * | 8/1995 | Lackie | 206/499 |
| 5,590,786 | A * | 1/1997 | Jaycox | 206/587 |
| 5,611,433 | A * | 3/1997 | Levy | 206/569 |
| 6,102,204 | A * | 8/2000 | Castleberry | 206/423 |
| 6,186,327 | B1 * | 2/2001 | Hadden | 206/472 |
| 6,349,830 | B1 * | 2/2002 | Lebron | 206/461 |
| 7,494,014 | B2 * | 2/2009 | Martinez | 206/705 |
| 2005/0173295 | A1 * | 8/2005 | Muraoka | 206/593 |

* cited by examiner

*Primary Examiner* — Luan K Bui
(74) *Attorney, Agent, or Firm* — Young Basile

(57) ABSTRACT

A shipping container for electrical storage cells includes a box and a plurality of tray elements adapted to be received in the box. The box defines an interior space having an inner periphery and a height. Each tray element has an outer periphery that substantially conforms to the inner periphery of the interior space of the box, and each tray element has at least one upwardly facing recess that substantially conforms to the shape an individual electrical storage cell.

14 Claims, 3 Drawing Sheets

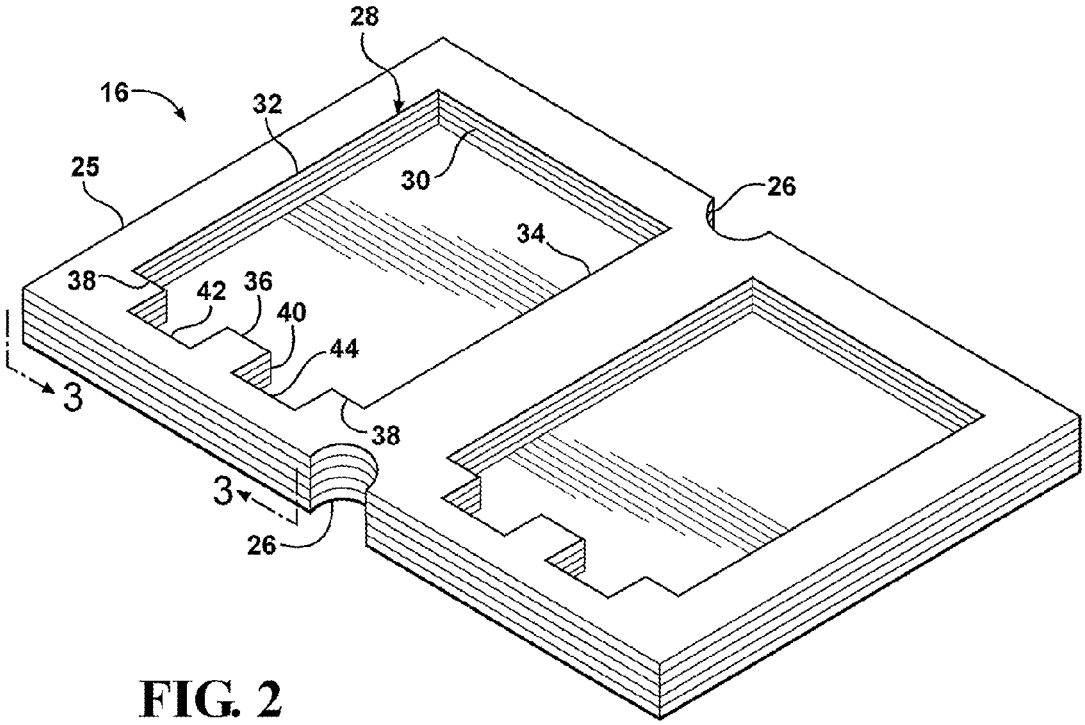
FIG. 2
FIG. 3
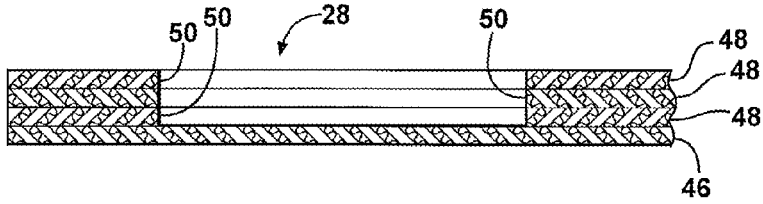

SHIPPING CONTAINER ASSEMBLY FOR ELECTRICAL STORAGE CELLS

CROSS-REFERENCE TO RELATED APPLICATIONS

This application claims the benefit of U.S. Provisional Application Ser. No. 61/140,162, filed Dec. 23, 2008.

FIELD OF THE INVENTION

The invention pertains to corrugated containers for the transportation of electrical storage cells having a high sensitivity to temperature extremes, physical damage, and electrical damage.

BACKGROUND OF THE INVENTION

The use of corrugated cardboard containers for the transport of goods is well known. A wide variety of corrugated containers and associated spacing and insert materials have been developed over the years to provide inexpensive, durable and recyclable protective containers.

Among the many products which have been packaged and shipped in these types of containers are a wide variety of electrical storage cells and electrical storage batteries, and a number of different designs of containers for batteries and cells are found in the prior art.

In recent times, however, there have been substantial and important developments in battery technology. Among those developments is the invention and commercial success of the lithium ion battery. The cells of a lithium ion battery are rechargeable electrical storage cell in which lithium ions move between the anode and cathode. Typically, the lithium ion moves from the anode to the cathode during discharge and from the cathode to the anode when charging.

Lithium ion batteries have become popular in a wide variety of consumer electronics, due in large part to their high output to weight ratio. Lithium ion batteries also exhibit no "memory effect", and retain a substantial portion of their charge when not in use.

However, lithium ion batteries and cells suffer from certain vulnerabilities, and unless appropriately used and stored, present certain dangers. In some situations, mistreatment of lithium ion batteries may cause them to burn or to explode. As a result of these hazards, the Federal Aviation Administration has expressed substantial concern about the carriage of lithium ion batteries as cargo on aircraft and has published rules that restrict the manner in which ion batteries may be transported on aircraft.

Lithium ion batteries are growing in popularity for use in automotive applications due to their high energy density. In automotive applications, individual lithium ion cells are often thin, planar structures that are square or rectangular in shape with electrodes which protrude from one end of the cell. For example, a typical automotive lithium ion cell may be approximately six inches wide, twelve inches long and one inch or less thick. During transportation, it is important that each individual cell be thoroughly protected above and below and around the perimeter. It is likewise important that the anode and cathode be protected from inadvertent short circuit.

As a result of the potential dangers associated with lithium ion batteries, it is important that such batteries be properly packaged for storage and shipment. The present invention provides substantial benefits in the art of battery transport and storage.

SUMMARY OF THE INVENTION

The present invention provides a shipping container for electrical storage cells that includes a box and a plurality of tray elements adapted to be received in the box. The box defines an interior space having an inner periphery and a height. Each tray element has an outer periphery that substantially conforms to the inner periphery of the interior space of the box, and each tray element has at least one upwardly facing recess that substantially conforms to the shape an individual electrical storage cell.

Each tray element may have a plurality of layers of corrugated cardboard that are bonded to one another in a vertically stacked configuration. The plurality of layers of corrugated cardboard may include a base layer that extends continuously within the outer periphery of the tray element, and the base layer may define a bottom interior surface of each recess of the tray element. The plurality of layers of corrugated cardboard may include one or more upper layers that are disposed above the base layer. The upper layers each have an aperture extending therethrough to at least partially define each recess of the tray element.

The base layer and the upper layers may have peripheries that are coincident with the outer periphery of the tray element.

The recess may includes a contoured side having a pair of terminal receiving portions that are each adapted to receive a terminal of one of the electrical storage cells.

The shipping container may also include a substantially planar cover panel that is disposed between the outer box and the plurality of tray elements, wherein the cover panel is adjacent to at least one of the recesses. The cover panel and the plurality of tray elements may cooperate to define a height that is substantially equal to the height of the interior space of the outer box.

Finally, the outer box, the plurality of tray elements and the cover panel may all be fabricated from corrugated cardboard.

BRIEF DESCRIPTION OF THE DRAWINGS

The description herein makes reference to the accompanying drawings wherein like referenced numerals refer to like parts throughout several views and wherein:

FIG. 2 is a perspective view showing a tray element of the shipping container;

FIG. 3 is a partial, cross-sectional view of the tray element of FIG. 2.

DETAILED DESCRIPTION

Figure 1:
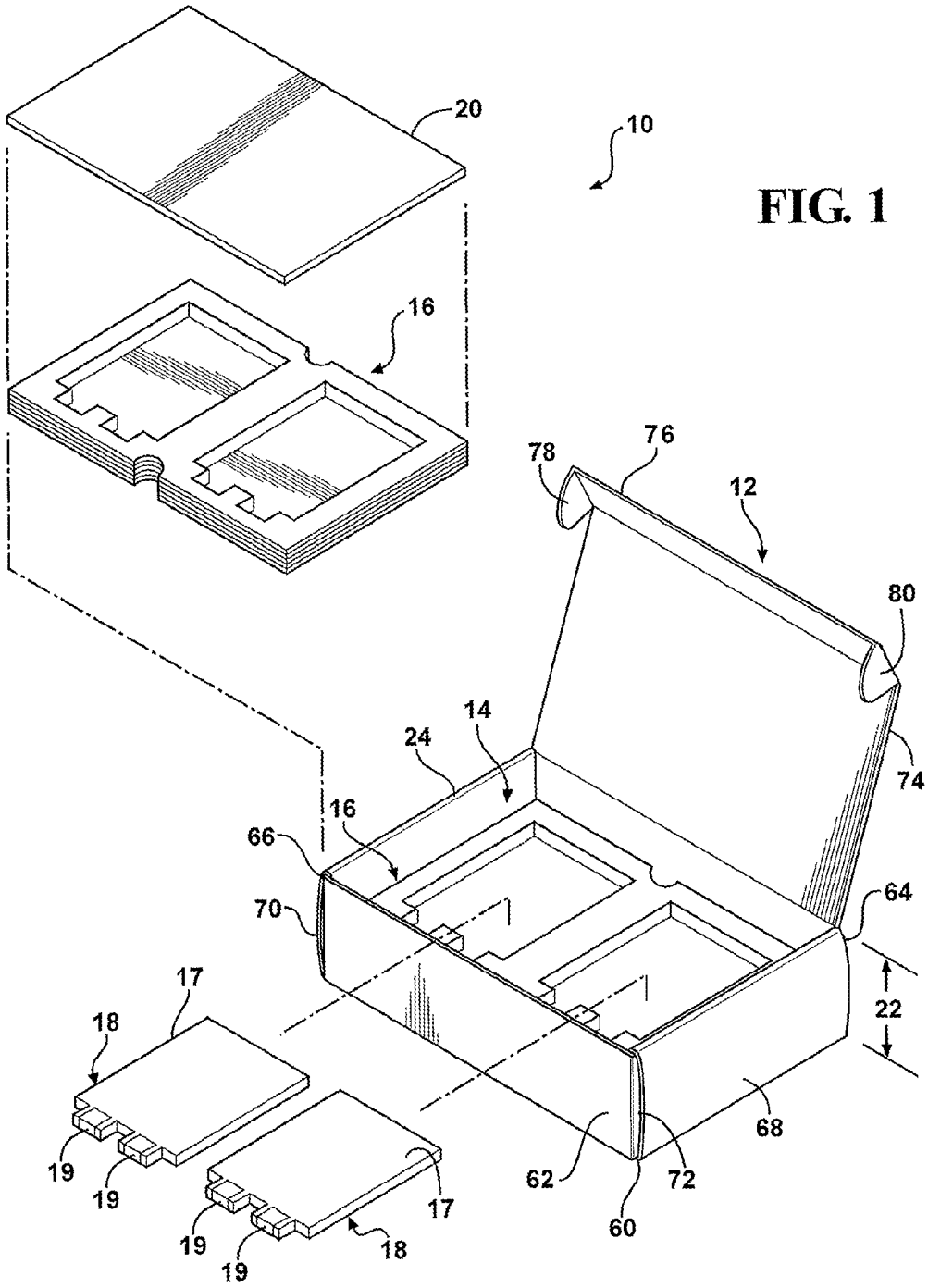
FIG. 1 is an exploded perspective view showing a shipping container according to the present invention for transporting electrical storage cells.

Referring to the drawings, the present invention will now be described in detail with reference to the preferred embodiment.

FIG. 1 shows a shipping container assembly 10 according to the present invention. The shipping container assembly 10 includes an outer box 12, one or more tray elements 16 and a cover panel 20, all of which are typically fabricated from corrugated cardboard. The outer box 12 defines an interior space 14 in which the tray elements 16 and the cover panel 20 are received.

The tray elements 16 and the cover panel 20 are components of a dunnage assembly that is received within the interior space 14 of the outer box 12 to support and stabilize one or more electrical storage cells 18. When disposed within the interior space 14 of the outer box 12, the dunnage assembly substantially conforms to a height 22 of the interior space 14, as well as an inner periphery 24 of the interior space 14, thus preventing movement of the dunnage assembly within the interior space 14 of the outer box 12.

The electrical storage cells 18 are individual cells that can be assembled with respect to one another into an electrical storage battery (not shown). The electrical storage cells 18 are preferably lithium ion electrical storage cells. Each of the electrical storage cells 18 has a substantially rectangular body portion 17 that is typically thin and planar. A pair of terminal blocks 19 protrude from one side of the body portion 17 of each of the electrical storage cells 18 and correspond to the anode and cathode of the electrical storage cell 18. When disposed within the shipping container assembly 10, the electrical storage cells are insulated from contact with electrically conductive materials, are not susceptible to exposure to significant amounts of static electricity, and the terminal blocks 19 of the electrical storage cells are prevented from coming into contact with one another, as will be explained further herein.

As seen in FIG. 2, the tray element 16 is a rectangular, generally planar structure that is bounded by a generally rectangular outer periphery 25. The outer periphery 25 may include slight deviations from a perfect rectangular shape, such as semi-circular notches 26 that allow the tray elements 16 to be removed from the outer box 12 with ease. The outer periphery 25 of each tray element 16 is shaped generally complementary in shape and size to the inner periphery 24 of the interior space 14 of the outer box 12 in order to restrain the tray elements 16 against moving with the interior space 14 of the outer box 12.

In order to secure the electrical storage cells 18 within the shipping container assembly 10, each tray element 16 includes one or more recesses 28. The recesses 28 are upwardly facing and shallow, having a height that is complementary to the electrical storage cells 18. For example, the recesses may have a height that is slightly greater than the height of the electrical storage cells 18, such that vertical motion of the electrical storage cells 18 is prevented or minimized while simultaneously preventing weight that is applied to the shipping container assembly 10 from being applied to the electrical storage cells 18.

The recesses 28 are also shaped complementary to the electrical storage cells 18 to prevent lateral movement of the electrical storage cells 18 within the recesses 28. For example, each recess 28 may be bounded a substantially linear rear side 30, a substantially linear left side 32, a substantially linear right side 34 a contoured side 36 opposite the rear side 30. The rear side 30, the left side 32 and the right side 34 define a generally rectangular area, while the contoured side 36 is configured to complement the terminals 19 of the electrical storage cells 18.

The contoured side 36 of each recess 28 may include one or more portions that engage a body portion 17 of each of the electrical storage cells 18, such as a pair of shoulder portions 38 that are formed adjacent to each of the left and right sides 32, 34 of the recess 28 and a central portion 40 that is formed between a first terminal area 42 and a second terminal area 44. The first and second terminal areas 42, 44 each receive one of the terminals 19 of the electrical storage cell 18, thereby isolating the terminals 19 from one another and stabilizing the position of the storage cell 18 with respect to the tray element 16.

In the illustrated embodiment, the tray element 16 includes two recesses 28. However, it should be understood that tray elements could be fabricated with other numbers of recesses, such as one recess, four recesses, ten recesses, etc.

As shown in FIG. 3, each tray element 16 is a layered structure that is fabricated from corrugated cardboard. In particular, each tray element includes a base layer 46 and one or more upper layers 48. The base layer 46 and the upper layers 48 are permanently connected to one another. For example, the base layer 46 and the upper layers 48 could be bonded together using adhesives. The outer peripheries of the base layer 46 and the upper layers 48 cooperate to define and are coincident with the outer periphery 25 of the tray element 16.

The base layer 46 is substantially continuous, lacking apertures or perforations within the confines of the outer periphery 25 of the tray element 16. The base layer 46 defines a bottom interior surface of each recess 28. Optionally, sub-base layers (not shown) could be provided below the base layer 46 and bonded thereto to stiffen the tray element 16.

One or more upper layers 48 are stacked on top of the base layer 46. The upper layers 48 each include an opening 50 that is formed through the respective upper layer by die-cutting or other suitable means such that the opening 50 extends completely through the corrugated cardboard from which the upper layer 48 is fabricated. With the exception of the openings 50, the upper layers 48 are substantially continuous within the confines of the outer periphery 25 of the tray element 16, thus allowing the tray elements 16 to resist crushing in the vertical direction. The openings 50 in the upper layers 48 are aligned with one another when assembled on top of the base layer 46 to define the sides 30, 32, 34, 36 and the depth of each of the recesses 28 of the tray element 16.

With reference again to FIG. 1, the outer box 12 includes a bottom panel 60, a front panel 62, a rear panel 64, a right side panel 66, and a left side panel 68 that cooperate to define the interior space 14 of the outer box 12. The right side panel 66 and the left side panel 68 define a right side closure pocket 70 and a left side closure pocket 72, respectively. A top panel 74 is pivotally connected to the rear panel 64 to allow closure of an open top of the interior space 14 of the outer box 12. When the top panel 74 is pivoted to a closed position, a front closure panel 76 that is connected to the top panel 74 substantially overlies the front panel 62 and a right closure flap 78 and the left closure flap 80 that are pivotally connected to the sides of the front closure flap 76 are each received in a respective one of the right closure pocket 66 and the left closure pocket 72 that are defined by the right side panel 66 and the left side panel 68 of the outer box 12.

Figure 4:
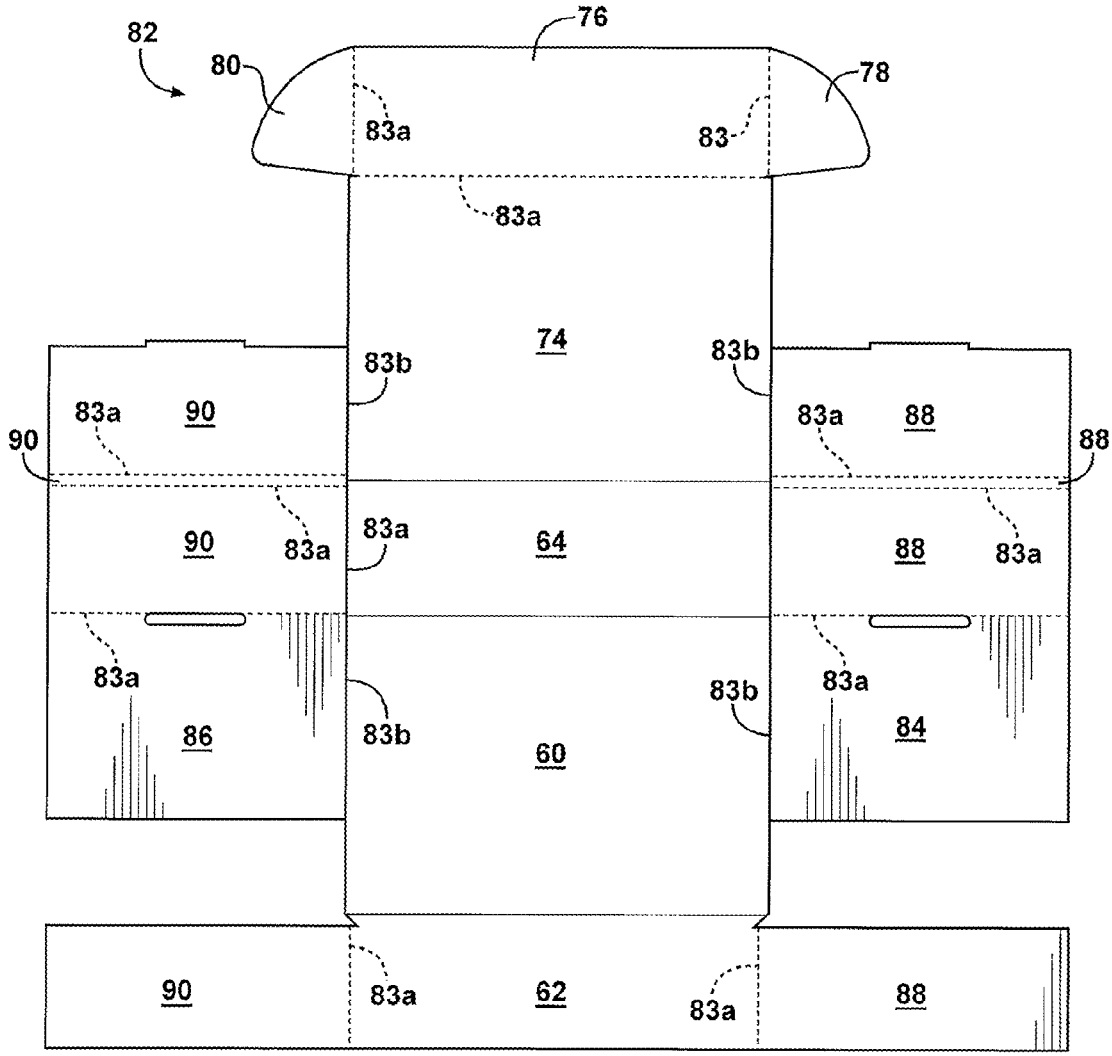
FIG. 4 is a plan view showing a box blank from which an outer box of the shipping container assembly of the present invention is fabricated.

The outer box 12 is fabricated from a box blank 82, as shown in FIG. 4. The box blank 82 includes portions corresponding to, and identically numbered to, respective portions of the outer box 12. In addition, the box blank 82 includes a plurality of right side panel portions 88 that are folded with respect to one another to provide the right side panel 66 of the outer box 12, as well as a plurality of left side panel portions 90 that are folded with respect to one another to provide the left side panel 68 of the outer box 12. The box blank 82 further includes a first internal bottom stiffening panel 84 and a second internal bottom stiffening panel 86 that overlie the bottom panel 60 of the outer box 12 when assembled to stiffen the bottom panel 60 of the outer box 12. The various portions of the box blank 82 are pivotally connected to one another at fold lines 83*a* that allow the box blank 82 to be folded into the outer box 12, and certain adjacent portions are separated from one another by cut lines 83*b* that allow for free movement of these adjacent portions with respect to one another.

In use, a user first constructs the outer box 12 from the box blank 82 by folding and gluing or otherwise securing the various panels to one another. The outer box 12 is then placed in an open position by pivoting the top panel 74 of the outer box 12 away from the interior space 14.

Next, the user places one of the tray elements 16 into the interior space 14 of the outer box 12. Then the electrical storage cells 18 are placed into the recesses 28 of the tray element 16. Additional tray elements 16 and electrical storage cells 18 are placed into the interior space 14 of the outer storage box 14 in correspondence to the height 22 of the interior space 14 of the outer box 12.

The cover panel 20 is placed on top of the upper most one of the tray elements 16, adjacent to the recesses 28 thereof, such that the cover panel 20 is interposed between the tray elements 16 and the top panel 74 of the outer box 12 when the top panel 74 of the box is in a closed position. The outer box 12 is then closed by moving the top panel 74 to the closed position.

While the invention has been described in connection with what is presently considered to be the most practical and preferred embodiment, it is to be understood that the invention is not to be limited to the disclosed embodiments, but on the contrary, it is intended to cover various modifications and equivalent arrangements included within the spirit and scope of the appended claims, the scope is to be accorded the broadest interpretation so as to encompass all such modifications and equivalent structures as is permitted under the law.

The invention claimed is:

1. A shipping container for electrical storage cells, comprising:

a box defining an interior space, the interior space having an inner periphery and a height; and a plurality of tray elements adapted to be received in the box, each tray element having a plurality of layers of corrugated cardboard that are bonded to one another in a vertically stacked configuration, an outer periphery that substantially conforms to the inner periphery of the interior space of the box, a substantially planar top surface, a substantially planar bottom surface, and at least one upwardly facing recess that is formed in the substantially planar top surface and substantially conforms to the shape and height of an individual electrical storage cell, the plurality of tray elements including a first tray element and a second tray element that are stacked with respect to one another such that the substantially planar top surface of the first tray element is in contact with the substantially planar bottom surface of the second tray element.

2. The shipping container of claim 1, further comprising:

the plurality of layers of corrugated cardboard including a base layer that extends continuously within the outer periphery of the tray element.

3. The shipping container of claim 2, wherein the base layer defines a bottom interior surface of each recess of the tray element.

4. The shipping container of claim 3, further comprising:

the plurality of layers of corrugated cardboard including one or more upper layers that are disposed above the base layer, the upper layers each having an aperture extending therethrough to at least partially define each recess of the tray element.

5. The shipping container of claim 4, further comprising:

the base layer and the upper layers having peripheries that are coincident with the outer periphery of the tray element.

6. The shipping container of claim 3, wherein the recess includes a contoured side having a pair of terminal receiving portions that are each adapted to receive a terminal of one of the electrical storage cells.

7. The shipping container of claim 1, further comprising:

a substantially planar cover panel that is disposed between the box and the plurality of tray elements, wherein the cover panel is adjacent to at least one of the recesses.

8. The shipping container of claim 7, wherein the cover panel and the plurality of tray elements cooperate to define a height that is substantially equal to the height of the interior space of the box.

9. The shipping container of claim 8, wherein the box, the plurality of tray elements and the cover panel are all fabricated from corrugated cardboard.

10. A shipping container for electrical storage cells, comprising:

a box defining an interior space, the interior space having an inner periphery and a height; and a plurality of tray elements adapted to be received in the box, each tray element having:

an outer periphery that substantially conforms to the inner periphery of the interior space of the box, a substantially planar top surface, a substantially planar bottom surface, at least one upwardly facing recess that is formed in the substantially planar top surface and substantially conforms to the shape of an individual electrical storage cell, wherein the recess includes a contoured side having a pair of terminal receiving portions that are each adapted to receive a terminal of one of the electrical storage cells, a base layer of corrugated cardboard that extends continuously within an outer periphery thereof, the base layer defining a bottom interior surface of the recess of the tray element, one or more upper layers that are disposed above the base layer and bonded thereto in a vertically stacked configuration, the one or more upper layers each having an aperture extending therethrough to at least partially define the recess of the tray element, and the base layer and the upper layers having peripheries that are coincident with the outer periphery of the tray element, wherein the plurality of tray elements include a first tray element and a second tray element that are stacked with respect to one another such that the substantially planar top surface of the first tray element is in contact with the substantially planar bottom surface of the second tray element.

11. The shipping container of claim 10, further comprising:

a substantially planar cover panel that is disposed between the box and the plurality of tray elements, wherein the cover panel is adjacent to at least one of the recesses.

12. The shipping container of claim 11, wherein the cover panel and the plurality of tray elements cooperate to define a height that is substantially equal to the height of the interior space of the box.

13. The shipping container of claim 12, wherein the box, the plurality of tray elements and the cover panel are all fabricated from corrugated cardboard.

14. A shipping container for electrical storage cells, comprising:

a box fabricated from corrugated cardboard and defining an interior space, the interior space having an inner periphery and a height;

a plurality of tray elements fabricated from corrugated cardboard and adapted to be received in the box, each tray element having a plurality of layers of corrugated cardboard that are bonded to one another in a vertically stacked configuration, each tray element having an outer periphery that substantially conforms to the inner periphery of the interior space of the box, the plurality of layers of corrugated cardboard including a base layer that extends continuously within the outer periphery of the tray element wherein the base layer defines a bottom interior surface of each recess of the tray element, the plurality of layers of corrugated cardboard including one or more upper layers that are disposed above the base layer, the one or more upper layers each having an aperture extending therethrough to at least partially define each recess of the tray element, the base layer and the one or more upper layers having peripheries that are coincident with the outer periphery of the tray element, and each tray element having at least one upwardly facing recess that substantially conforms to the shape an individual electrical storage cell, wherein the recess includes a contoured side having a pair of terminal receiving portions that are each adapted to receive a terminal of one of the electrical storage cells; and a substantially planar cover panel that is fabricated from corrugated cardboard and is disposed between the box and the plurality of tray elements, wherein the cover panel is adjacent to at least one of the recesses, wherein the cover panel and the plurality of tray elements cooperate to define a height that is substantially equal to the height of the interior space of the box.

* * * * *